US005743840A

United States Patent [19]

Carr

[11] Patent Number: 5,743,840

[45] Date of Patent: Apr. 28, 1998

[54] CENTRIFUGE WITH A HEATING JACKET FOR DRYING COLLECTED SOLIDS

[75] Inventor: Robert B. Carr, Brookline, Mass.

[73] Assignee: Carr Separations, Inc., Franklin, Mass.

[21] Appl. No.: 669,600

[22] Filed: Jun. 24, 1996

[51] Int. Cl.[6] ..... B04B 11/08; B04B 15/02; B04B 15/08

[52] U.S. Cl. ..... 494/13; 494/37; 494/38; 494/58; 494/61; 34/58; 34/321

[58] Field of Search ..... 494/13, 14, 37, 494/38, 41, 50, 55, 58, 60, 61, 62, 80, 85; 210/175, 184, 186, 364–366, 369, 372–376, 380.1, 770; 34/58, 132, 134, 315, 321

[56] References Cited

U.S. PATENT DOCUMENTS

| | | | |
|---|---|---|---|
| 2,167,881 | 8/1939 | Eberts et al. | 494/14 X |
| 3,821,857 | 7/1974 | Mercier | 34/58 X |
| 4,030,897 | 6/1977 | Pelzer et al. | 494/13 X |
| 4,052,304 | 10/1977 | Vertenstein | 494/13 X |
| 4,691,448 | 9/1987 | Alstetter et al. | 34/58 X |
| 4,770,772 | 9/1988 | Kuwajima et al. | 210/184 |
| 5,163,895 | 11/1992 | Titus | 494/13 X |
| 5,281,275 | 1/1994 | Milner | 494/61 X |
| 5,460,717 | 10/1995 | Grimwood et al. | 34/132 X |

*Primary Examiner*—Charles E. Cooley
*Attorney, Agent, or Firm*—Darby & Darby

[57] ABSTRACT

A centrifuge of the type including a housing and a rotatable bowl, and including a heating jacket located therebetween. The heating jacket is established through inflatable seals which selectively seal a space located between the bowl and the housing. The seals may be inflated when the bowl is stationary. A heating fluid is then introduced into the heating jacket so that collected solids in the bowl may be heated and dried. A vacuum may be applied to the bowl to assist in the removal of moisture from the solids. A scraper assembly, including at least one scraper, is disposed within the bowl. The scraper assembly pivots between a stowed position and an operative position to remove the solid that has collected on the inside wall surface of the bowl.

9 Claims, 3 Drawing Sheets

CENTRIFUGE WITH A HEATING JACKET FOR DRYING COLLECTED SOLIDS

FIELD OF THE INVENTION

The present invention relates to centrifuges, and more particularly, to centrifuges used in separating and processing large volumes of a solids end product, similar to the operation of a neutch machine.

BACKGROUND OF THE INVENTION

A neutch machine is a filter/dryer that is used primarily in the pharmaceutical and chemical industries to filter, solvent-wash, and thermally dry a crystalline solids cake in batches. The solids cake is usually valuable and sensitive to air exposure and other contamination and are therefore completely processed and treated within a controlled environment within the machine. One problem with these machines is that they use a single plate filter having a limited surface area to separate solids from a liquid feed. The use of a plate filter to collect solids is relatively inefficient and produces a small yield of solids for each batch. Another problem is that the filters used in these neutch machines have difficulty with fine solids and also with semi-solids which tend to blind the filter screen.

Once the filter of the neutch machine collects its predetermined amount of a solids cake, it must be scraped to remove the wanted solids, and then cleaned prior to producing subsequent batches. Each scraped batch of solids is collected within the machine and further treated (washed and dried) prior to removal from the machine. The overall yield of the machine is low.

OBJECTS OF THE INVENTION

An object of the invention is to provide an imperforate bowl centrifuge separator which collects a solids cake by sedimentation and overcomes the deficiencies of the prior art.

Another object of the invention is to provide a centrifuge separator which dries a collected solids cake while it remains within a collection bowl.

SUMMARY OF THE INVENTION

A centrifuge includes a housing and a rotatable bowl. The bowl receives a liquid feed and through centrifugal forces generated during rotation, separates and collects a solid component of the liquid feed. The centrifuge includes a heat exchange device for heating the collected solids within the bowl. Preferably, the heat exchange device comprises a heating jacket which envelopes the bowl and which can be closed by means of inflatable seals so that a hot fluid can be retained within the heating jacket.

DETAILED DESCRIPTION OF THE PREFERRED EMBODIMENT

Figure 1:
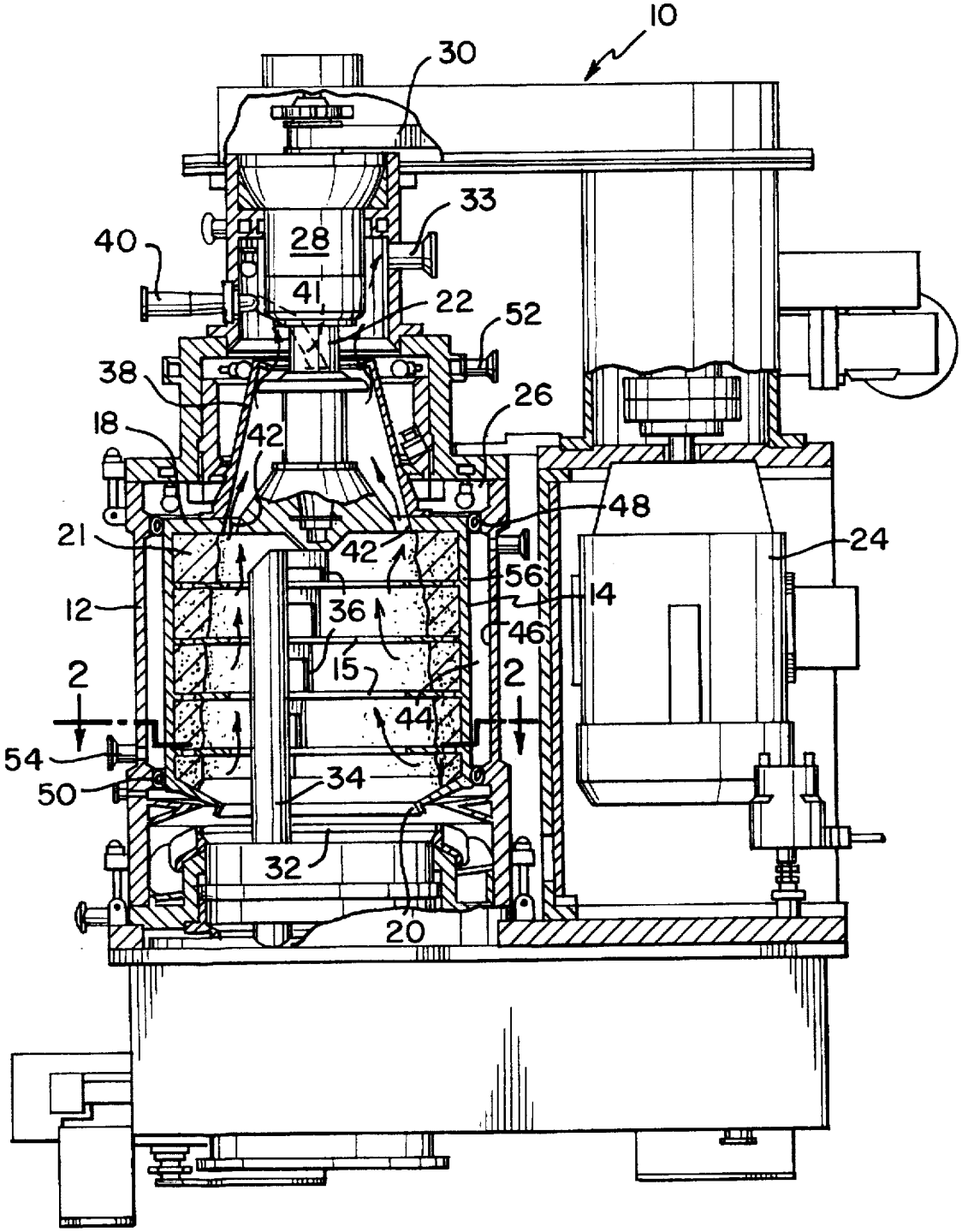
FIG. 1 is an overall sectional side view of a centrifuge separator in accordance with the invention.
Figure 2:
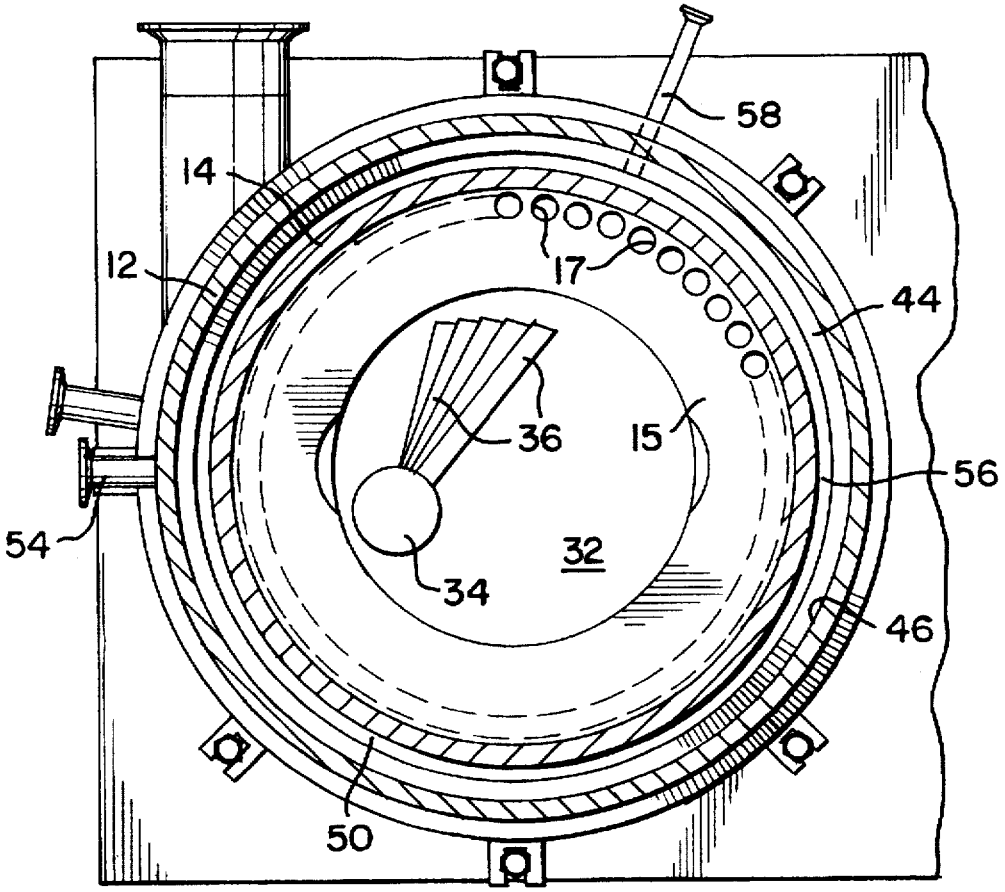
FIG. 2 is a cross-sectional view, taken along the lines 2—2 of FIG. 1.

Referring to FIG. 1, a centrifuge separator 10 is shown in accordance with the invention including a housing 12, a solids collection bowl 14 having an upper end 18, an open end 20, and a collection region wherein solids 21 are collected within bowl 14. The bowl is secured to a drive shaft 22 which is rotated by a motor 24. As is well known in the art of centrifuge separation, bowl 14 is positioned within a bowl chamber 26 formed in housing 12 and is attached to drive shaft 22 at its upper end 18. Drive shaft 22 is rotatably supported within housing 12 by bearings 28. An upper end of drive shaft 22 is connected to motor 24, either directly or through a belt 30.

Bowl 14 includes annular baffles 15 each including a plurality of openings 17 so that the incoming liquid can flow through the centrifuge. Baffles 15 and openings 17 assist in the separating process, as is known in the art.

The open lower end of bowl 14 forms a discharge opening 32 through which collected solids 21 may pass during a discharge procedure, described below. A scraper assembly 34 is pivotally attached to housing 12 and extends upwardly into bowl 14 through discharge opening 32. Scraper assembly 34 includes at least one scraper 36 (five scrapers are shown in FIG. 1) and preferably includes a spray jet nozzle 37 used to clean the interior of bowl 14 during a cleaning procedure, described below. Scraper assembly 34 can pivot between a stowed position in which scrapers 36 are positioned away from the inside wall surface of bowl 14, and an operative position in which scrapers 36 are positioned close to the inside wall surface of bowl 14. As is known in the art, scraper assembly 34 may be pivoted between its stowed position and its operative position in a controlled manner to gradually and effectively remove the solids cake 21 that has collected along the inside wall surface of bowl 14. As the solids cake 21 is scraped from the inside wall surface of bowl 14, it falls through discharge opening 32 and is collected and subsequently handled appropriately, as is known in the art.

A feed cone 38 is provided at upper end 18 of bowl 14. Liquid feed is introduced to feed cone 38 from a feed inlet port 40 through an appropriate fluid passage 41. Feed cone 38 rotates with bowl 14 and is used to gradually increase the rotational speed of the liquid feed and introduce it to rotating bowl 14 through openings 42. In the preferred embodiment of the invention, a vacuum port 33 is provided in housing 12 to connect chamber 26 with an external vacuum pump (not shown). Negative pressure applied to vacuum port 33 directly affects the environment within chamber 26 and the interior of bowl 14, creating an equal negative pressure therein. The vacuum assists in removing moisture from the collected solids cake in bowl 14, as described further below and illustrated by arrows in FIG. 1.

In accordance with the preferred embodiment of the invention, a heating jacket 44 is formed within chamber 26 of housing 12, adjacent to and circumferentially around bowl 14. Heating jacket 44 preferably is contiguous to at least the collection region of bowl 14, and is defined by an outside wall surface 56 of bowl 14, an inside wall surface 46 of housing 12, an upper inflatable ring seal 48, and a lower inflatable ring seal 50.

Figure 4:
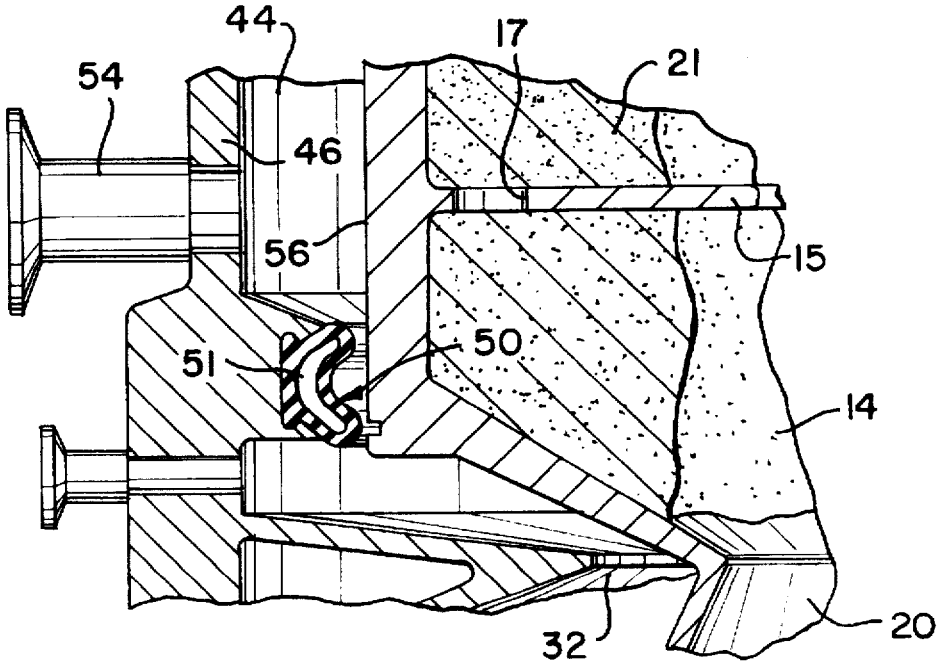
FIG. 4 is an enlarged partial sectional side view of a lower ring seal shown in a deflated or retracted condition, in accordance with the invention.
Figure 3:
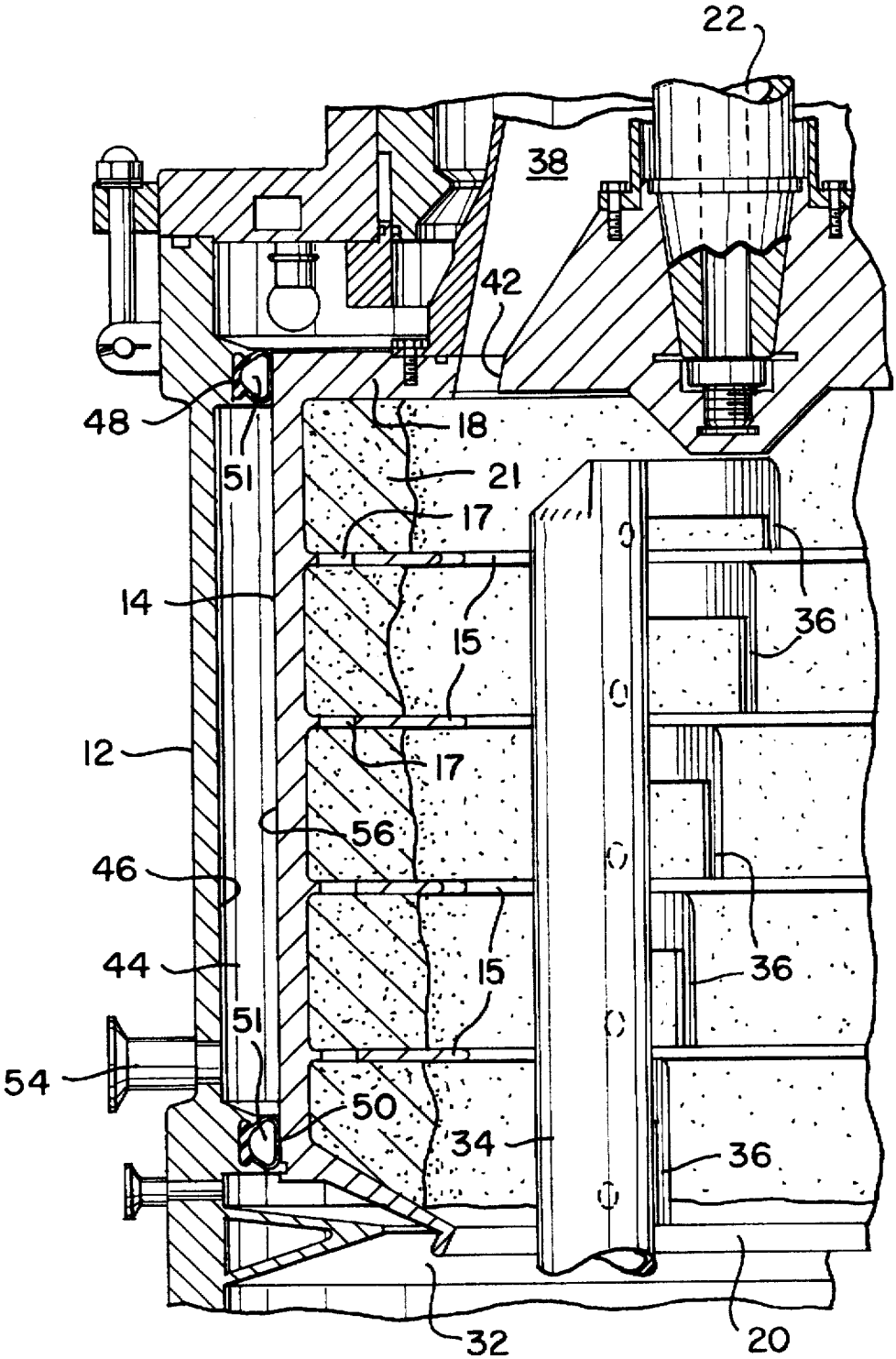
FIG. 3 is an enlarged partial sectional side view of the centrifuge separator of FIG. 1 showing details of a centrifuge bowl and expandable sealing rings, shown in an inflated condition, in accordance with the invention.

Ring seals 48, 50 each include a hollow cavity 51 and are preferably made from an expandable plastic or rubber material. Such inflatable ring seals are sold commercially under the trademark PNEUMA SEAL and are available from The Presray Corporation, Pawling, N.Y. As shown in FIGS. 3 and 4, each ring seal 48, 50 includes a flange (not numbered) which fits into a complementary groove within housing wall 46 so that upper ring seal 48 and lower ring seal 50 envelopes the upper and lower ends of bowl 14. Ring seals 48, 50 are adapted to expand radially inwardly to an inflated or expanded condition, as shown in FIG. 3, from a collapsed condition, as shown in FIG. 4, when each respective hollow cavity 51 is inflated by a pressurized fluid, such as allow weight hydraulic oil or gas. The ring seals 48, 50 thus seal heating jacket 44 so that a heated fluid may be introduced into the jacket to heat the outer surface 56 of bowl 14 and thereby dry the solids cake 21.

An inlet port 52 is used to introduce the heated fluid directly into heating jacket 44. Once introduced, the heated fluid circulates and transfers its heat energy directly to bowl 14 and indirectly to the collected solids 21 within bowl 14. An outlet port 54 is located at a lower portion of heating jacket 44 and is used to remove the heated fluid within heating jacket 44 for reheating and recirculation.

The heated fluid used to heat the bowl 14 and collected solids cake 21 may be any suitable fluid including steam, heated oil or air. In accordance with the invention, other devices may be used to heat the cake 21. For example, instead of heating jacket 44, heating coils connected adjacent to the outer wall 56 of bowl 14 may be used. In operation, as bowl 14 rotates, liquid feed enters through feed port 40 and is introduced into feed cone 38 and bowl 14 through openings 42. As bowl 14 continues to rotate, the liquid feed within bowl 14 separates and solids begin to collect along the inside wall surface. Liquid feed is continuously discharged from bowl 14 at its lower end 20 and simultaneously replenished at its upper end 18. This process continues until a sufficient amount of solids cake 21 has collected on the side walls of bowl 14.

At this point, prior art centrifuge separators scrape out and discharge the collected solids cake and possibly treat the solids cake outside the protected environment afforded by housing 12. In contrast, using centrifuge separator 10 according to the invention, the collected solids cake may be heated while remaining along the walls of bowl 14 prior to its discharge.

Before to heating the collected solids cake, rotation of bowl 14 is stopped. Both ring seals 48, 50 are then inflated by forcing fluid through a passage 58 which is connected to the hollow cavity 51 located within each ring seal 48, 50. As the fluid is forced into hollow cavity 51, each ring seal 48, 50 expands radially inwardly into sealing contact with outside wall surface 56 of bowl 14. Once a predetermined amount of pressure is supplied to ring seals 48, 50 (ensuring a proper seal between housing 12 and stopped bowl 14), heating jacket 44 is established and heated fluid may be introduced therein. Expanded ring seals 48, 50, as shown in FIG. 4, form a liquid-tight seal against outside wall surface 56 and thereby ensure that no fluid within heating jacket 44 escapes.

As described above, the heated fluid preferably circulates from inlet port 52, through heating jacket 44 and into contact with outside wall surface 56, passing through outlet port 54 for reheating and recirculation.

The solids cake is heated sufficiently to draw off a predetermined amount of contained liquid as vapor. The vapor is drawn from bowl 14 through vacuum supply port 33. Once it is determined that the collected solids cake is sufficiently dry, ring seals 48, 50 are deflated so they no longer contact outer wall surface 56 of bowl 14, and bowl 14 is free to rotate. Bowl 14 is rotated at a predetermined scraping rate and scraper assembly 34 is pivotally displaced into contact with the dried collected solids cake. The solids cake falls through discharge opening 32 at lower end 20 of bowl 14, and is appropriately collected.

The present invention may be embodied in other specific forms without departing from the spirit or essential attributes thereof, and, accordingly, reference should be made to the appended claims, rather than to the foregoing specification, as indicating the scope of the invention.

What is claimed is:

1. A centrifuge of the type including a housing and a rotatable bowl, said centrifuge being adapted to separate by way of centrifugal force and collect within said bowl a solids component of an introduced liquid feed, said centrifuge comprising:

means for heating said collected solids within said bowl, said heating means comprises inflatable ring seals located between said housing and said bowl, said ring seals being inflatable between a collapsed condition wherein said seals are spaced from said bowl and said bowl is free to rotate, and an inflated condition when said bowl is stationary wherein said seals are in sealing contact with said housing and said bowl, said ring seals in said inflated condition forming a sealed heating jacket between the housing and the bowl through which a heated fluid may flow.

2. The centrifuge according to claim 1, further comprising means for creating a vacuum within said bowl to draw off any vapor released from said solids during heating of said solids.

3. A centrifuge of the type including a housing and a rotatable bowl, said centrifuge being adapted to separate by way of centrifugal force and collect within a collection region of said bowl a solids component of an introduced liquid feed, said bowl operatively located with said housing and defining a space therebetween, said centrifuge comprising:

means for sealing said space between said bowl and said housing when said bowl is stationary, said sealing means forming a sealed heating jacket between said housing and said bowl through which a heated fluid may flow adjacent to said collection region to heat said collected solids.

4. The centrifuge according to claim 3, further comprising means for creating a vacuum within said bowl to draw off any vapor released from said solids during heating of said solids.

5. A method for drying a collected solids component of a liquid feed within a collection bowl of a centrifuge, the steps comprising:

centrifuging a liquid feed to separate a solids component from a centrate, the solids component collecting in a collection region of the bowl;

stopping a rotation of the bowl;

heating the collected solids component to evaporate contained moisture and thereby dry the collected solids while the bowl is stopped; and scraping the dried collected solids from the collection bowl.

6. The method for drying according to claim 5, further comprising the step of establishing a vacuum within the collection bowl to draw evaporated moisture from the solids component before the heating step.

7. A centrifuge of the type including a housing and a rotatable bowl, said centrifuge being adapted to separate by way of centrifugal force and collect within said bowl a collected solids component of an introduced liquid feed, said centrifuge comprising:

a heating jacket being disposed circumferentially around said bowl, said heating jacket being defined by an outside wall surface of said bowl, an inside wall surface of said housing, an upper inflatable ring seal and a lower inflatable ring seal.

8. The centrifuge according to claim 7, wherein said upper ring seal and said lower ring seal are each disposed between said housing and said bowl.

9. The centrifuge according to claim 8, wherein said upper ring seal and said lower ring seal are each inflatable between a collapsed condition wherein said seals are spaced from said bowl and said bowl is free to rotate, and an inflated condition when said bowl is stationary wherein said seals are in sealing contact with said housing and said bowl.

* * * * *